United States Patent [19]

Hillgenberg

[11] 3,977,595

[45] Aug. 31, 1976

[54] CARTON WITH TAB LATCH CLOSURE

[75] Inventor: David E. Hillgenberg, La Habra, Calif.

[73] Assignee: Dolco Packaging Corporation, Burbank, Calif.

[22] Filed: Apr. 7, 1975

[21] Appl. No.: 566,011

[52] U.S. Cl. ..... 229/45 R; 229/2.5 R; 229/29 M; 24/230 SC; 292/87

[51] Int. Cl.[2] ..... B65D 45/00; B65D 1/26

[58] Field of Search ..... 229/2.5, 44, 45, 29 M; 24/230 SC, 230 CF, 230 SL; 292/DIG. 38

[56] References Cited

UNITED STATES PATENTS

| | | | |
|---|---|---|---|
| 1,194,309 | 8/1916 | Miller | 292/87 |
| 3,251,110 | 5/1966 | Hedu | 24/230 SC |
| 3,346,171 | 10/1967 | Baker | 229/29 M X |
| 3,767,110 | 10/1973 | Congleton | 229/45 |
| 3,844,000 | 10/1974 | Hedu | 24/230 SC |
| 3,876,130 | 4/1975 | Haase | 229/44 R |

FOREIGN PATENTS OR APPLICATIONS

| | | | |
|---|---|---|---|
| 225,262 | 10/1959 | Australia | 229/29 M |
| 306,441 | 11/1968 | Sweden | 24/230 SC |

*Primary Examiner*—Davis T. Moorhead
*Attorney, Agent, or Firm*—Nilsson, Robbins, Dalgarn & Berliner

[57] ABSTRACT

A carton comprising a pair of space-defining members with confronting closing edges which lock by means of a tab latch. The latch includes a tab which extends from one of the closing edges to pass through a loop formed on a wall adjacent the opposite closing edge. The tab includes a terminal portion which extends through the loop and which has a rear surface that conforms to the wall region rearwardly adjacent the loop. The tab also includes a protuberance on its front, outer surface which is insertable through the loop by deformation of the loop and which is retained thereby. In particular embodiments, the carton is integrally formed in one piece of expanded plastic material with sections of the closing edges hinge-connected. In a specific configuration, the walls of the space defining members taper inwardly from the closing edges so that the tab forms an acute angle with the closing edge from which it extends.

10 Claims, 6 Drawing Figures

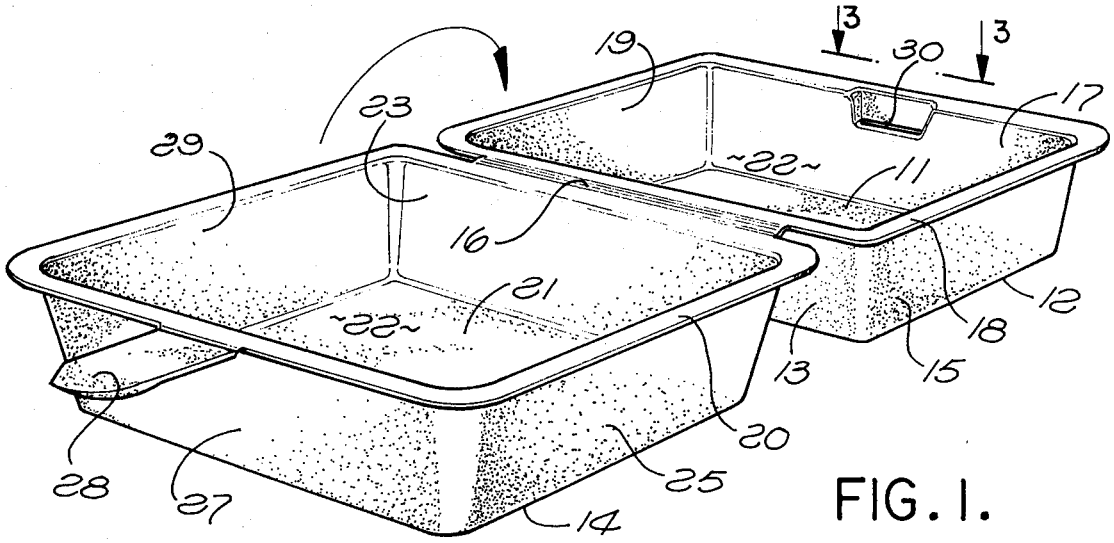
FIG. 1.
FIG.2.
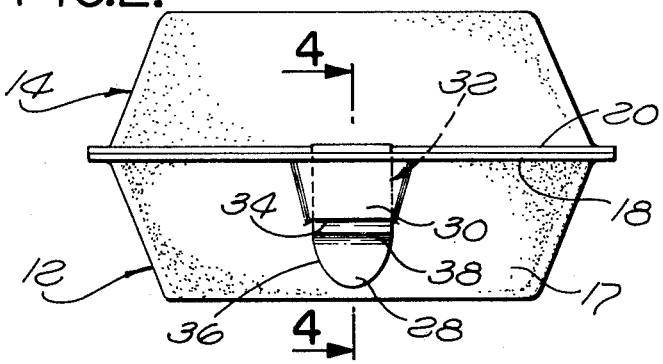
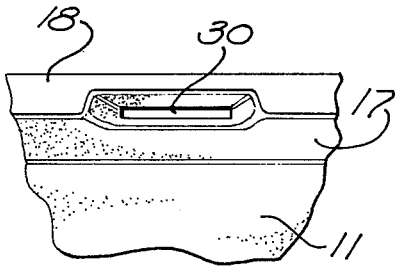
FIG. 3.
FIG.4.
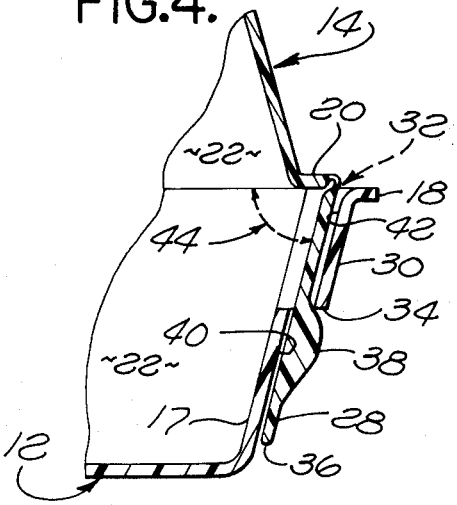
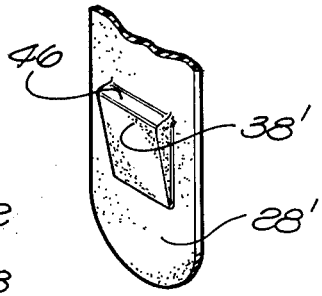
FIG.5.
FIG.6.
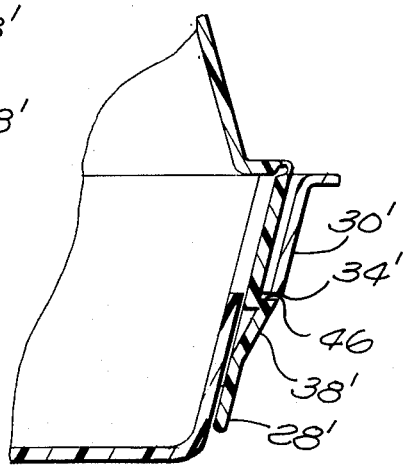

CARTON WITH TAB LATCH CLOSURE

FIELD OF THE INVENTION

The field of art to which the invention pertains is the field of container assemblies.

BACKGROUND AND SUMMARY OF THE INVENTION

The manufacture of disposable containers for various solid articles generally involves a highly developed technology and a multitude of cartons have been developed and used which incorporate closure latches which are integral with the carton. Specifically, various forms of cartons are in widespread use in which two closing sections are folded together, with the fold line serving as a hinge so that the carton can be repeatedly opened and closed. Integral latch structures have been included in such cartons in many different specific forms. One class of integral-carton latch structures employs a latch tab or flap extending from one part of the carton for mating engagement with a retainer on the other section and examples of such structures can be found in U.S. Pat. Nos. 3,537,251 (Edwards), 3,556,387 (Trimble) and 3,767,110 (Congleton). Generally, such integral-carton, latch structures require that the tab be inherently resilient and therefore rather severe limitations are imposed upon the material that may be employed in the carton. Additionally, the manner by which such members are stressed tends to determine the capacity of the closure. For example, a plain tab of carton material can offer only small resistance to bending forces but can effectively resist tension forces. As a result, the engagement between various members of conventional carton materials sometimes tends to be rather ineffective to resist forces that accidentally open the carton. Particular problems are found with the use of expanded plastic material, such as expanded polystyrene, as the carton material since tabs formed of such expanded material will tolerate only a limited repetition of flexure before breaking down. Accordingly, the manner by which the tabs are deformed to effect closure is rather important to the effective life and use of the carton. An additional problem which attends the use of expanded plastic material is that the highly effective insulating properties of such material can result in moisture condensation when a carton thereof is used to enclose a hot food item, such as a hamburger, or the like, with resultant sogginess of the food item. Some means of ventilation would therefore be desirable.

Accordingly, a need exists for an improved carton incorporating an effective integral latching mechanism. More specifically, important features of such a mechanism reside in the ability to maintain a carton closed, economy of manufacture, ability to withstand vibration and shock, ability to withstand repeated openings and closures, convenience of use and ventilating ability. Generally, the present invention provides an improved structure in view of such considerations.

Specifically, a carton is provided which comprises a pair of space-defining members with confronting closing edges which lock by means of a tab-latch. A portion of one of the walls forms a loop well adjacent its closing edge for receiving a tab carried in extension from an opposing closing edge. The tab is formed with a protuberance which deforms the loop during insertion therethrough and which is thereafter retained by the trailing edge of the loop. The outer rear edge surfaces of at least the terminal portion of the tab are in substantial contour conformance to the wall region rearwardly adjacent the loop for effecting close engagement. In a particular embodiment, the walls of at least the loop bearing member taper inwardly from its closing edge and the loop includes a trailing edge parallel to the wall so that the tab is directed inwardly against the wall region thereat forming an acute angle with the closing edge of the opposite member. The resulting configuration provides resistance to transverse forces which may otherwise tend to open the carton and additionally provides a close fitting relationship between the tab and the carton wall, decreasing the possibility of the tab portion being caught by misadventure during handling of the carton and thereby decreasing the incidence of tab breakage. The loop-protuberant tab configuration employed herein enables the carton to be repeatedly opened and closed with little wear and little change in the latching capability of the carton. Additionally, an integral hinge is provided and the closing edges are defined by flanges or lips which provide substantial overlap capability. Although not readily evident from a casual consideration of the foregoing, the present carton structure, containing such combination of elements and the loop-tab mechanism, provides a rearward shifting upon closure of the top member, revealing a passageway through the loop well which serves to ventilate the carton.

BRIEF DESCRIPTION OF THE DRAWINGS

FIG. 1 is a perspective view of a carton constructed in accordance herewith shown in an open configuration;

FIG. 2 is a front elevational view of the carton of FIG. 1 shown in a closed position;

FIG. 3 is a detailed plan view of the loop portion of the latch, taken on line 3—3 of FIG. 1, in the direction of the arrows;

FIG. 4 is a vertical sectional view taken along the line 4—4 of FIG. 2, in the direction of the arrows;

FIG. 5 is a perspective view of a tab constructed in accordance with an alternative embodiment of the invention; and FIG. 6 is a vertical sectional view similar to that of FIG. 4, but illustrating the tab of FIG. 5.

DETAILED DESCRIPTION

As required, detailed illustrative embodiments of the invention are disclosed herein. The embodiments exemplify the invention which may, of course, be embodied in other forms, some of which may be radically different from the illustrative embodiments. However, the specific structural and functional details disclosed herewith are representative and they provide a basis for the claims herein which define the scope of the invention. Additionally, certain conventions may be utilized, such as referring to bottom and top members, but which positions can be reversed or which could be described as side members, and it will be appreciated that a particular orientation utilized is chosen simply for convenience of description and not as a means of limiting of the invention.

Referring initially to FIG. 1, there is shown a carton which includes a bottom space-defining member 12 and a top space-defining member 14 affixed together by an integral hinge 16 so that they may be opened and closed in aligned facing engagement. A closing edge for the bottom member 12 is defined by a flange or lip 18 extending outwardly from the peripheral edge of the member 12 and a similar flange or lip 20 extends radially from the top member 14 to define a closing edge therefor. Generally, the members 12 and 14 each define a space that is closed on five sides so as to provide a common chamber 22 (FIG. 4) therebetween when the members are closed with the lips 18 and 20 in surface engagement. More specifically, the bottom member 12 includes a bottom wall 11 and side walls 13, 15, 17 and 19 therearound. Similarly, the top member 14 includes a top wall 21 and side walls 23, 25, 27 and 29 therearound. The lips 18 and 20 extend outwardly, substantially parallel to the bottom and top walls 11 and 21, respectively, to afford abutting surfaces when closed together.

As illustrated, the members 12 and 14 comprise an integral unit which may be formed, for example, of expanded plastic, such as expanded polystyrene, with a hinge 16 simply comprising a line of weakness in the integrally-molded structure.

Additionally, a flap 28 is integral with and extends from the top member lip 20 to provide a latch for engagement through a locking well 30 which is defined by the confronting wall 17 and lip 18 of the bottom member 12. Specifically, and referring to FIGS. 2, 3 and 4 for additional details, the locking well 30 is in the form of a loop defined by the bottom member wall 17 and lip 18 through which the tab 28 extends. As will be more evident in FIG. 4, by insertion of the tab 28 through the well loop 30, there occurs a rearward shifting of the top member 14 respective the bottom member 12 so that a passageway is formed through the locking well 30 into the common chamber 22, as indicated by the arrow 32 in FIGS. 2 and 4. Such a passageway is particularly advantageous when the carton is used to contain hot food, such as a hamburger, or the like, and serves as a means for ventilating moisture from the food item so that the food item does not become soggy from condensed moisture but rather retains a dry texture. The combined provision of confronting flanges or lips 18 and 20, integral hinge and rearward shifting by tab insertion through the well loop 30 thus provides ventilated protection for the enclosed item in a rather simple, yet effective manner.

Referring more particularly to FIGS. 2 and 4, there can be seen certain advantageous structural characteristics of the present invention. Specifically, the well loop 30 includes a trailing edge 34 which extends spaced forwardly or outwardly from, but substantially parallel to, the plane of the surface of the front wall 17. Accordingly, the tab 28 is directed so as to lie flat against the surface of the front wall 17 minimizing protrusion therefrom, thereby minimizing the misadventures which can occur to tabs, such as hooking thereof by items of clothing and the like. Additionally, it will be noted that the terminal portion of the tab 28 is formed, at least along its edges 26, so as to be in contour conformance with the outer surface of the wall 17 region which is rearwardly adjacent the loop. In other words, in this particular configuration where the wall 17 is flat, the inner surface of the tab 28 is similarly flat so as to lie in the same plane. Reference is made to the outer edges of the tab since the center portion thereof can be scooped out (as will be illustrated with regard to the tab of FIGS. 5 and 6) but the outer edges constitute a flat closure with the wall 17, aided in this regard by the parallel extent of the trailing edge 34 of the well loop 30.

In addition to the foregoing characteristics, the tab 28 will be seen to include a protuberance 38 on its outer surface. The protuberance is somewhat wider than the distance separating the outer surface 40 of the front wall 17 and inner surface 42 of the locking well loop 30. Accordingly, upon insertion of the tab 28 through the loop 30, the loop 30 is deformed until passage thereby of the protuberance 38 and thereafter the trailing edge 34 of the loop 30 serves to retain the tab against rearward, or upward motion. Accordingly, there is somewhat of a horizontal pawl effect obtained with the protuberance which serves to prevent accidental withdrawal of the tab 28 upwardly through the loop 30. However, when it is desired to open the container, one need merely push up with his finger on the protuberance 38 to again deform the loop 30, passing the tab 28 upwardly through the loop 30 and permitting the container to be opened.

As a further additional feature of the present invention, the walls of at least the bottom member 12 are formed so as to taper inwardly from its lip 18. As a result of such taper, upon inserting the tab 28 through the locking well loop 30, the tab 28 forms an acute angle 44 with the top member lip 20. As a result, additional resistance against lateral forces is obtained, providing a secure closure. Additionally, by similarly tapering the top member 14, one can provide a carton which readily stacks with cartons of like structure so that a large plurality of cartons can be stored and shipped in a minimum of space.

Referring now to FIGS. 5 and 6, an alternative embodiment is disclosed which is similar in all respects to the embodiment of FIGS. 1–4 except for the specific configuration of the tab 28' utilized in FIGS. 5 and 6. The tab 28' includes a protuberance 38' which is formed as a hollowed out structure, but with a sharp top edge 46. The edge 46 serves to ratchet-lock the tab with respect to the sharp trailing edge 34' of the locking well loop 30'. Such tab configuration enables a more positive lock but can also be released when desired by pushing in on the protuberance 38', with only a small amount of force greater than that required in opening the carton of FIGS. 1–4.

The entire composite structure as considered above, may be formed as an integral unit in a single molding operation. Various molding techniques as pressure forming polystyrene sheet stock, for example, may be effectively employed to accomplish the desired form. Thereafter, die-cutting techniques may be employed to provide the structure substantially as disclosed above. Match mold forming, vacuum forming or other forming and cutting techniques may also be used to produce the illustrative embodiments or various other embodiments hereof.

Of course, variations are possible. For example, in place of a flat contour surface for the wall 17, one may use an undulated surface, or any desired surface, and it will be understood that some of the advantages as described above can be obtained by also undulating or correspondingly forming the confronting surface of the tab 28 or 28' so that there is contour conformation as above described. Other variations are possible and in this regard, the scope of the present invention is deemed to be in accordance with the claims as set forth below.

I claim:

1. A carton, comprising:

a first space-defining member formed with walls terminating in a first closing edge;

a second space-defining member formed with walls terminating in a second closing edge for engagement with said first closing edge to define a chamber between said members bounded by said walls;

a portion of said second member wall extending outwardly, forming a closed loop having a leading edge adjacent said second closing edge and having a trailing edge, said leading edge being wider than said trailing edge; and a tab hingedly connected to said first closing edge and extending therefrom for insertion through said loop, said tab being narrower along its length than the leading edge of said loop, thereby providing a passageway along at least one side thereof, through said loop thereat into said carton;

said loop and tab being formed to secure said tab against said second member when received through said loop.

2. The carton of claim 1 wherein said tab includes a protuberance on its outer surface, spaced from said first closing edge and insertable through said loop by deformation thereof whereby to be retained by said loop.

3. The carton of claim 1 wherein said trailing edge is parallel to said second member wall.

4. The carton of claim 3 wherein said tab includes a terminal portion for extension from said trailing loop edge, the outer edges of said terminal tab portion being in substantial contour conformance to the wall region rearwardly adjacent said loop.

5. The carton of claim 4 wherein said terminal tab portion includes a protuberance on its outer surface insertable through said loop by deformation of said loop whereby to be retained by said trailing loop edge.

6. The carton of claim 4 wherein said wall region is substantially flat.

7. The carton of claim 1 wherein the walls of said second space defining member taper inwardly from said second closing edge, said tab forming an acute angle with said first closing edge when received through said loop.

8. The carton of claim 1 wherein a section of said first closing edge is integrally connected to a section of said second closing edge to provide a hinge between said first and second space-defining members.

9. The carton of claim 1 wherein each said closing edge comprises a lip substantially around and extending outwardly from the respective space-defining member.

10. The carton of claim 1 formed of expanded plastic material, wherein a section of said first closing edge is integrally connected to a section of said second closing edge to provide a hinge between said first and second space-defining members, and wherein each said closing edge comprises a lip substantially around and extending outwardly from the respective space-defining member whereby upon closing of said carton said first member shifts rearwardly respective said loop to enlarge said passageway.

* * * * *